US007762022B2

(12) United States Patent
Stadler et al.

(10) Patent No.: US 7,762,022 B2
(45) Date of Patent: Jul. 27, 2010

(54) AUTOMATIC DOOR OPENING AND CLOSING SYSTEM AND METHOD OF CONTROL THEREOF

(75) Inventors: Michael F. Stadler, Pittsburgh, PA (US); Thomas P. Schluep, Mars, PA (US); Joseph E. DeSisto, Beaver, PA (US)

(73) Assignee: BEA, Inc., Pittsburgh, PA (US)

( * ) Notice: Subject to any disclaimer, the term of this patent is extended or adjusted under 35 U.S.C. 154(b) by 1038 days.

(21) Appl. No.: 11/365,287

(22) Filed: Mar. 1, 2006

(65) Prior Publication Data

US 2007/0008124 A1 Jan. 11, 2007

Related U.S. Application Data

(60) Provisional application No. 60/697,512, filed on Jul. 8, 2005.

(51) Int. Cl.
*E06B 3/00* (2006.01)

(52) U.S. Cl. ..... 49/506; 49/25

(58) Field of Classification Search ..... 49/25, 49/506; 109/2, 3, 6, 9
See application file for complete search history.

(56) References Cited

U.S. PATENT DOCUMENTS 3,609,914 A * 10/1971 Berl ..... 49/5
3,852,592 A * 12/1974 Scoville et al. ..... 250/221
4,733,081 A * 3/1988 Mizukami ..... 250/341.8
4,823,010 A * 4/1989 Kornbrekke et al. ..... 250/341.7
4,851,746 A 7/1989 Milke
4,967,083 A * 10/1990 Kornbrekke et al. ..... 250/341.7
5,410,149 A * 4/1995 Winston et al. ..... 250/221
5,414,249 A * 5/1995 Matsumoto ..... 235/384
5,542,211 A * 8/1996 Colombo ..... 49/42
5,583,405 A 12/1996 Sai et al.
5,704,163 A * 1/1998 Kocznar ..... 49/47
5,963,000 A * 10/1999 Tsutsumi et al. ..... 318/480
6,012,252 A * 1/2000 Kocznar et al. ..... 49/46
6,170,194 B1 * 1/2001 Kocznar et al. ..... 49/46
6,304,178 B1 * 10/2001 Hayashida ..... 340/545.1
6,450,404 B1 * 9/2002 Imazuka ..... 235/381
6,678,999 B2 * 1/2004 Zengguang et al. ..... 49/25
6,744,369 B2 * 6/2004 Sata ..... 340/573.1
6,750,441 B2 * 6/2004 Imahori et al. ..... 250/221
6,782,660 B2 * 8/2004 Takada et al. ..... 49/25
6,812,837 B2 11/2004 Ikeuchi
6,914,401 B2 * 7/2005 Semelka ..... 318/480
6,970,085 B2 * 11/2005 Okabe et al. ..... 340/545.6
7,045,764 B2 * 5/2006 Beggs et al. ..... 250/221
7,061,383 B2 * 6/2006 Davis et al. ..... 340/573.1
7,332,999 B2 * 2/2008 Fitzgibbon ..... 340/5.71
7,360,695 B2 * 4/2008 Ponert et al. ..... 235/382
7,378,641 B2 * 5/2008 Melcher et al. ..... 250/221
7,392,617 B2 * 7/2008 Wallerstorfer et al. ..... 49/47
2002/0104266 A1 8/2002 Ranaudo

* cited by examiner

*Primary Examiner*—Jerry Redman
(74) *Attorney, Agent, or Firm*—The Webb Law Firm

(57) ABSTRACT

A swinging automatic door control system includes an activation sensor for acquiring images of a first area where the door swings when opening or closing, a presence sensor for detecting motion in a second area that fronts a non-swinging side of the door when said door is closed, and a controller for controlling the opening and closing of the door as a function of the acquired images of a first area and the detection of motion in the second area.

9 Claims, 8 Drawing Sheets

AUTOMATIC DOOR OPENING AND CLOSING SYSTEM AND METHOD OF CONTROL THEREOF

CROSS REFERENCE TO RELATED APPLICATION

This application claims priority from U.S. Provisional Patent Application No. 60/697,512, filed Jul. 8, 2005, which is incorporated herein by reference.

BACKGROUND OF THE INVENTION

1. Field of the Invention

The present invention relates to automatic swinging doors and, more particularly, to a system and method for controlling the opening and closing of automatic swinging doors.

2. Description of Related Art

Systems and methods are well-known in the art for controlling the opening and closing the automatic swinging doors to permit pedestrians to enter and exit buildings, facilities, hallways, and the like without having to open and close the doors manually. Automatic swinging doors controlled in accordance with such systems and methods are commonly found in retail stores, supermarkets, and the like.

Examples of automatic swinging door control systems are found in U.S. Pat. No. 4,851,746 to Milke; U.S. Pat. No. 5,583,405 to Sai et al.; U.S. Pat. No. 6,812,837 to Ikeuchi; and in U.S. Patent Application Publication No. 2002/0104266 to Ranaudo.

Notwithstanding the sophistication of the prior art automatic swinging door opening systems and methods, there is an ongoing need to improve the operation of automatic swinging door opening systems and methods to avoid contact between a moving automatic swinging door and a pedestrian in the swing path of such door.

SUMMARY OF THE INVENTION

The invention is a method of controlling a swinging automatic door. The method includes (a) providing means for acquiring images of a first area where the door swings when opening or closing, wherein the means for acquiring images is stationary; (b) providing means for detecting motion in a second area that fronts a non-swinging side of the door when said door is closed, wherein the means for detecting motion is stationary; (c) causing the means for acquiring images to acquire first and second images of the first area when the door is closed and open, respectively, and the first area; includes no object that would interfere with the opening or closing of the door; (d) causing the door to transition from closed to open when the means for detecting motion detects motion in the second area and a third image of the first area acquired by the means for acquiring images when the door is closed is the same as the first acquired image; (e) temporarily ceasing at least one of the following when the door is opening: the acquisition of images from the first area or the processing of images acquired from the first area when the door is opening; (f) causing the door to transition from open to closed when a fourth image of the first area acquired by the means for acquiring images when the door open is the same as the second acquired image and the means for detecting motion does not detect motion in the second area; and (g) temporarily ceasing at least one of the following when the door is closing: the acquisition of images from the first area or the processing of images acquired from the first area.

The means for acquiring images and the means for detecting motion can be different.

The method can further include causing the door to remain closed when the third image of the first area acquired by the means for acquiring images is different than the first image. The method can further include causing the door to remain open when the fourth image of the first area acquired by the means for acquiring images is different than the second acquired image.

The method can further include repeating steps (d)-(g) a plurality of times.

The method can further include providing means for detecting the presence of an object adjacent a swing side of the door. When the door is opening, the door can be caused to cease opening and remain motionless when the means for detecting the presence of an object detects an object adjacent the swing side of the door.

The means for detecting the presence of an object can acquire images of a third area adjacent the swing side of the door. The door can be caused to cease opening and remain motionless when a difference is detected between two or more images acquired of the third area by the means for detecting the presence of an object when the door is opening.

The method can further include providing means for detecting the presence of an object adjacent the non-swinging side of the door. When the door is closing, the door can be caused to transition from closing to open when the means for detecting the presence of an object detects an object adjacent the non-swinging side of the door.

The means for detecting the presence of an object can acquire images of a fourth area adjacent the non-swinging side of the door. The door can be caused to transition from closing to open when a difference is detected between two or more images acquired of the fourth area by the means for detecting the presence of an object when the door is closing.

The invention is also a swinging automatic door control system. The control system includes means for acquiring images of a first area where the door swings when opening or closing, for detecting motion in a second area that fronts a non-swinging side of the door and means for storing first and second images of the first area when the door is closed and open, respectively, and no unwanted object is present in the first area. Means is provided for causing the door to transition from closed to open when motion is detected in the second area and a current image acquired of the first area when the door is closed is the same as the first stored image. Means is also provided for temporarily terminating at least one of the acquisition of images from the first area and the processing of images acquired from the first area when the door is opening. The control system also includes means for causing the door to transition from open to closed when a current image acquired of the first area when the door is open is the same as the second stored image and motion is not detected in the second area. Lastly, the control system includes means for temporarily terminating at least one of the acquisition of images from the first area and the processing of images acquired from the first area when the door is closing.

The control system can also include means for causing the door to not transition from closed to open when a current image of the first area is different than the first image and/or means for causing the door to not transition from open to closed when a current image of the first area is different than the second image.

Means can be provided for detecting the presence of an undesired object adjacent a swing side of the door and for causing the door to cease opening and remain motionless when the undesired object is detected adjacent the swing side of the door when the door is opening. The means for detecting and causing can acquire images of a third area adjacent the swing side of the door and causes the door to cease opening and remain motionless when a difference is detected between two or more images acquired of the third area when the door is opening.

Means can also be provided for detecting the presence of an undesired object adjacent the non-swinging side of the door and for causing the door to open when the undesired object is detected adjacent the non-swinging side of the door when the door is closing. The means for detecting and causing can acquire images of a fourth area adjacent the non-swinging side of the door and causes the door to open when a difference is detected between two or more images acquired of the fourth area when the door is closing.

DETAILED DESCRIPTION OF THE INVENTION

The present invention will be described with reference to the accompanying figures where like reference numbers correspond to like elements.

Figure 1:
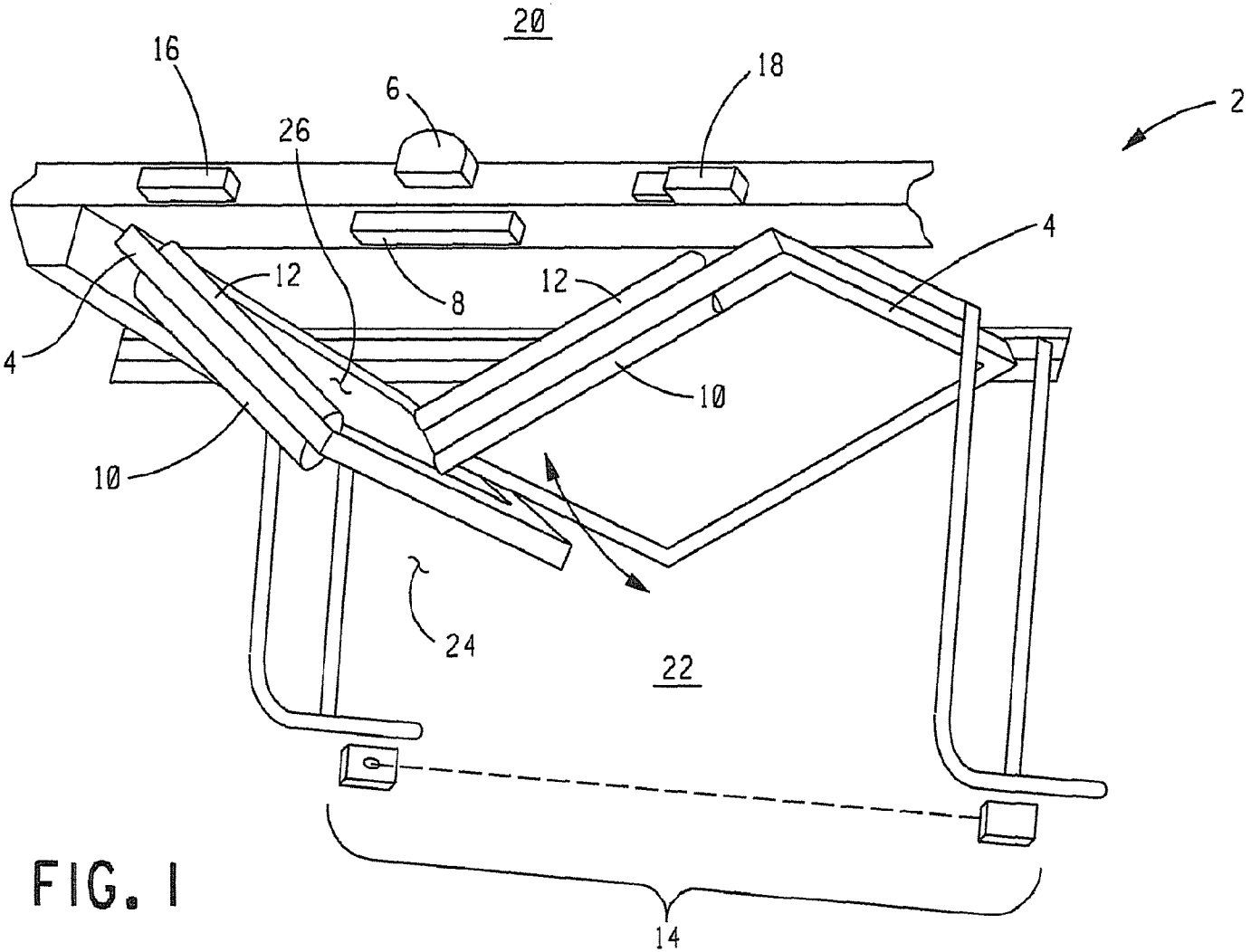
FIG. 1 is a perspective view of a pair of automatic swinging door and a door control system in accordance with the present invention.
Figure 2:
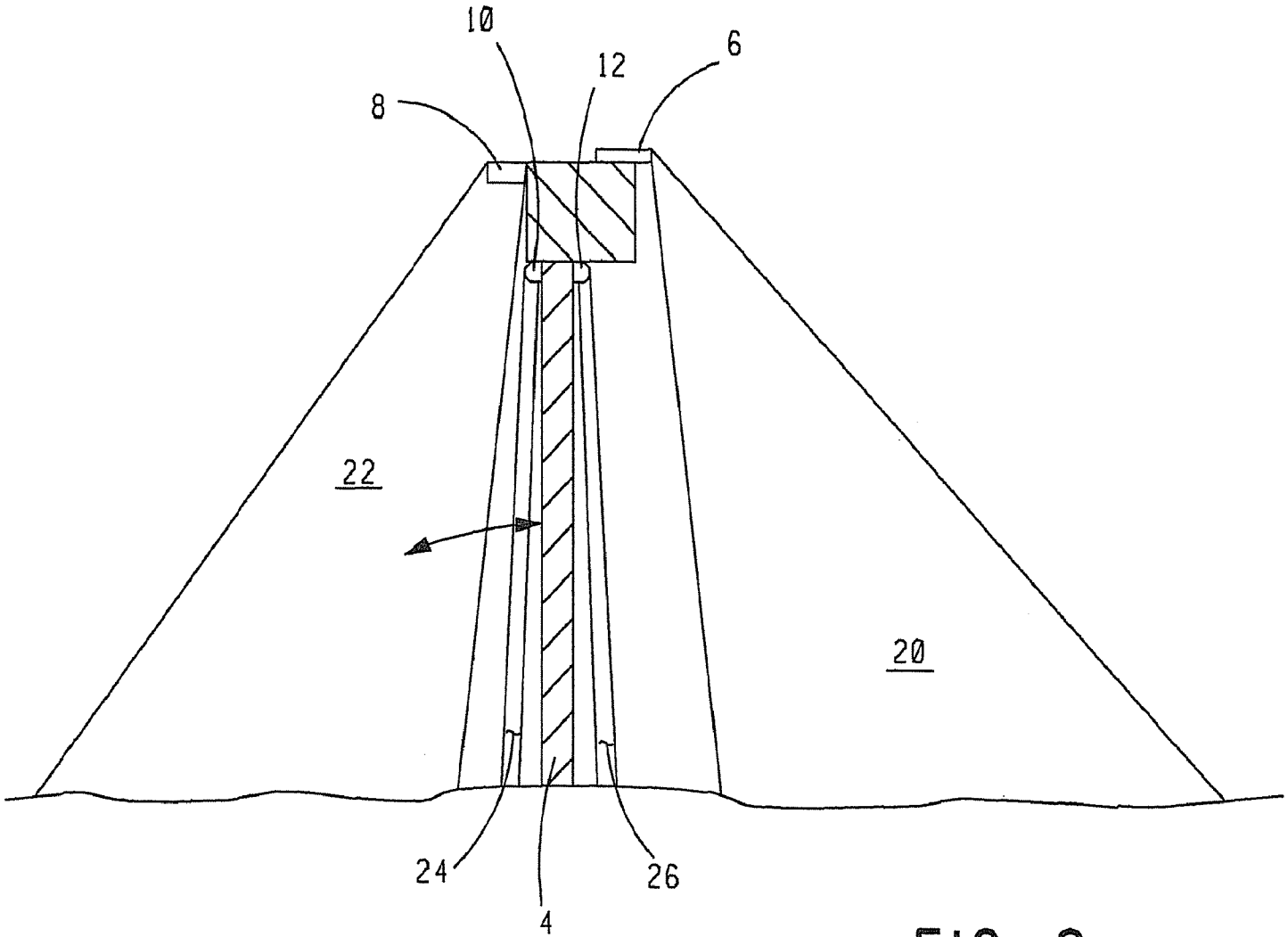
FIG. 2 is a cross-sectional side view of one of the doors shown in FIG. 1 in a closed position along with the fields-of-view of the various sensors of the door control system of the present invention.
Figure 3:
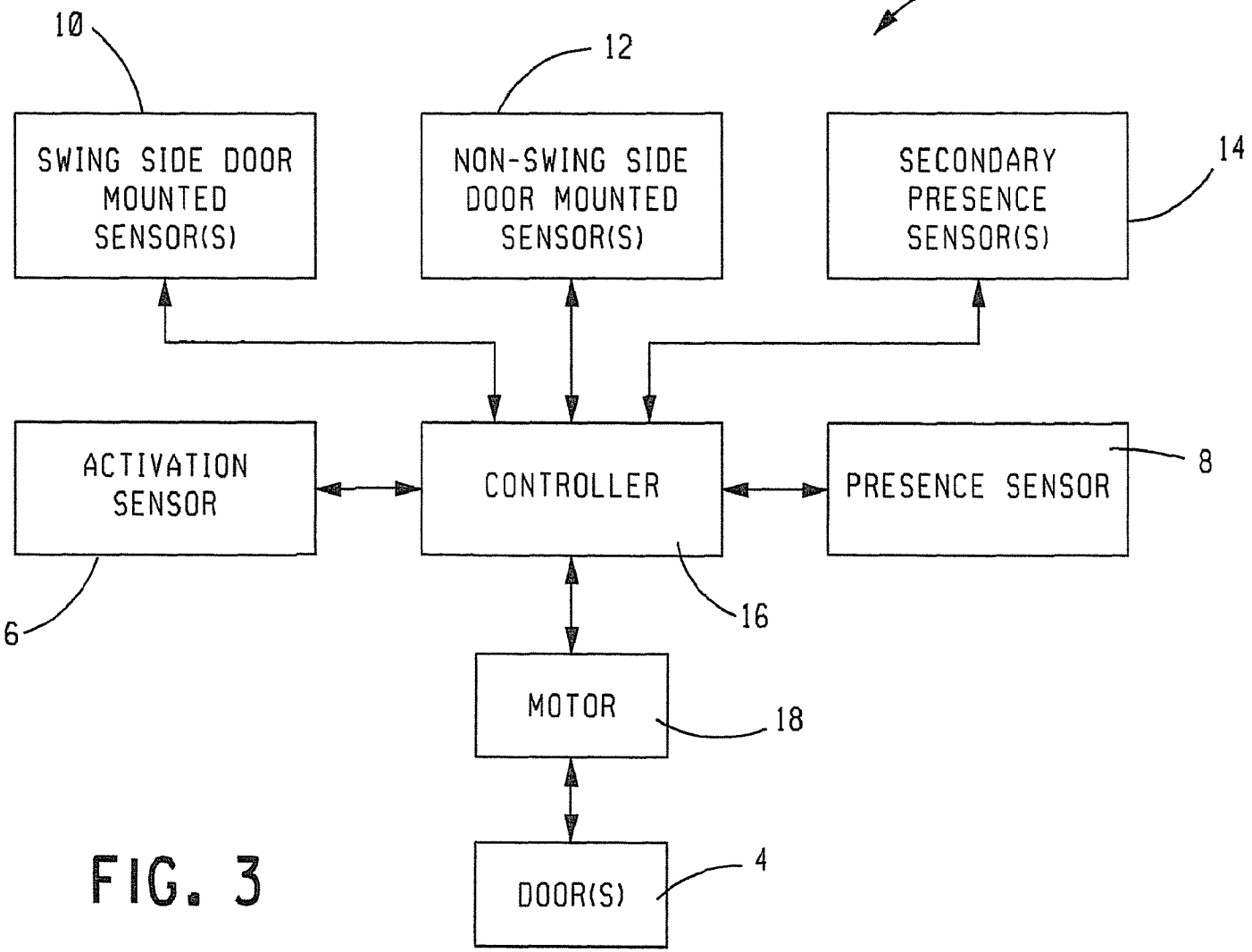
FIG. 3 is a block diagram of the door control system shown in FIG. 1.

With reference to FIGS. 1-3, a door control system 2 for automatically controlling the opening and closing of one or more swinging door(s) 4 includes an activation sensor 6, a presence sensor 8, a swing side door mounted sensor 10 mounted on the swing side of each door 4, a non-swing side door mounted sensor 12 mounted to the non-swing side of each door 4, an optional secondary presence sensor 14, a controller 16 coupled to receive the outputs of sensors 6-14, and a motor 18 operating under the control of controller 16 for opening and closing door(s) 4.

Activation sensor 6 can be a sensor of any suitable type for detecting motion in an area or field-of-view 20 located in front of the non-swinging side of each door 4 when said door is closed. A non-limiting example of a suitable activation sensor includes an ultrasonic motion sensor which is responsive for measuring a Doppler shift in the reflection of an ultrasound wave output thereby. However, this is not to be construed as limiting the invention since any suitable motion sensing detector can be utilized.

Each sensor 8-12 can be any suitable type of sensor that is capable of acquiring images in a corresponding area or field-of-view. An example of a suitable presence sensor includes an infrared sensor which acquires reflections of infrared light output thereby. However, this is not to be construed as limiting the invention. Desirably, secondary presence sensor 14, if provided, can be any suitable type of sensor that activates in some manner detectable by controller 16 when an object is present in a predetermined path, e.g., a light beam sensor. However, this is not to be construed as limiting the invention.

For each sensor 8-12, controller 16 determines if an object is present in the corresponding area or field-of-view of the sensor by comparing two or more images acquired by the sensor. If an object moves into the field-of-view of the sensor, controller 16 will detect a difference between an image acquired from the field-of-view without the object present and an image acquired from the field-of-view with the object present. Controller 16 interprets any differences in two or more images acquired by each sensor 8-12 as an indication that an undesired object is present in the field-of-view of the sensor. For simplicity of describing the present invention hereinafter, each sensor 8-12 will be described as detecting an object in its corresponding field-of-view. However, it is to be understood that such detection is actually accomplished by controller 16 detecting a difference between two or more images acquired by the sensor. Similarly, hereinafter, each sensor 8-12 described as not detecting an object in its field-of-view is to be understood as controller 16 determining that two or more images acquired from the sensor are the same.

Presence sensor 8 is mounted and configured for detecting the presence or absence of an object in an area or field-of view 22 where each door 4 swings when opening or closing.

Each swing side door mounted sensor 10 detects the presence or absence of an object in an area or field-of-view 24 adjacent the swing side of its corresponding door 4. Each non-swing side door mounted sensor detects the presence or absence of an object in an area or field-of-view 26 adjacent the non-swing side of the corresponding door 4.

The depiction in FIG. 2 of field-of-views 22 and 24 being separated from each other is not to be construed as limiting the invention since it is envisioned that field-of-view 22 can be enlarged to overlap field-of-view 24 and, perhaps, even overlap field-of-view 26. Similarly, the depiction of field-of-views 20 and 26 being separated from each other is not to be construed as limiting the invention since it is envisioned that field-of-view 20 can be enlarged to overlap field-of-view 26. Moreover, while field-of-views 24 and 26 tend to run closely adjacent opposite sides of door 4, this is not to be construed as limiting the invention since field-of-view 24 and/or field-of-view 26 can be of any suitable size selected by one of ordinary skill in the art.

Figure 4:
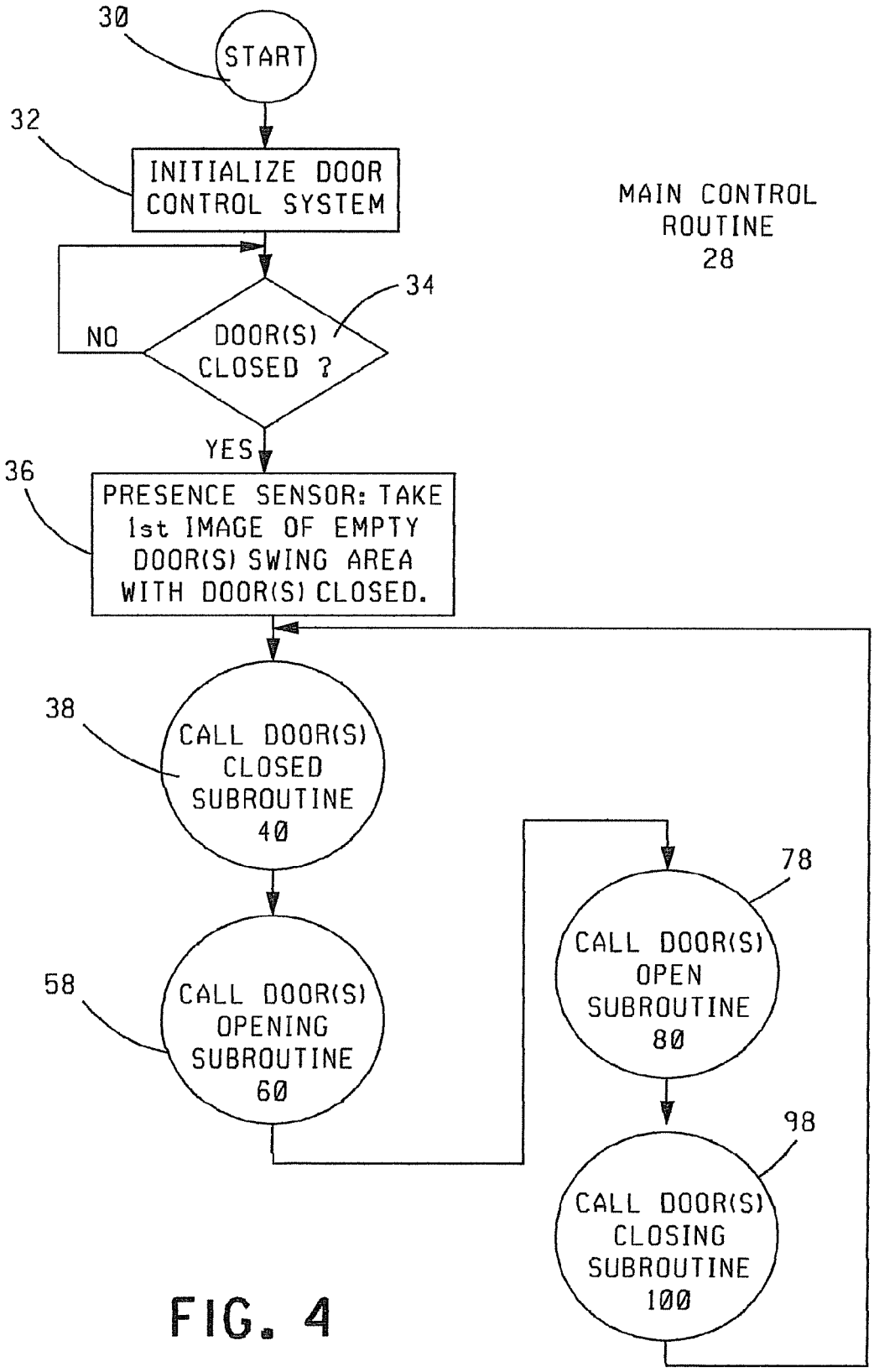
FIG. 4 is a flow diagram of a main control routine of the door control system of the present invention for controlling the operation of the door control system shown in FIG. 1.

With reference to FIG. 4 and with continuing reference to all previous figures, the operation of door control system 2 will now be described with reference to a main control routine 28. In main control routine 28, the method commences by advancing from a start step 30 to a step 32 wherein door control system 2 is initialized. This initialization includes, without limitation, applying power to controller 16 and each sensor 6-14 and initializing a data storage of controller 16, e.g., RAM, Flash Memory, and the like. However, this is not to be construed as limiting the invention.

The method then advances to step 34 wherein controller 16 causes motor 18 to close door(s) 4. Controller 16 determines that door(s) 4 is/are closed by comparing the voltage on the motor winding(s) of motor 18 in response to driving door(s) 4 to the closed position to a predetermined voltage indicative of door(s) 4 in the closed position. Controller 16 can determine the voltage on the motor winding(s) of motor 18 by suitable means, such as an analog-to-digital converter (not shown).

Once controller 16 determines that door(s) 4 is/are closed, the method advances to step 36 wherein controller 16 causes presence sensor 8 to acquire a first image of its corresponding field-of-view 22 when each door 4 is closed and no unwanted object is present in field-of-view 22. Desirably, the absence of an unwanted object in field-of-view 22 is confirmed by an operator who is causing door control system 22 to execute steps 32-36, e.g., by activating a reset button (not shown) of controller 16, by cycling power to door control system 2, etc. Controller 16 stores the first image acquired by presence sensor 8 in its data storage.

Figure 5:
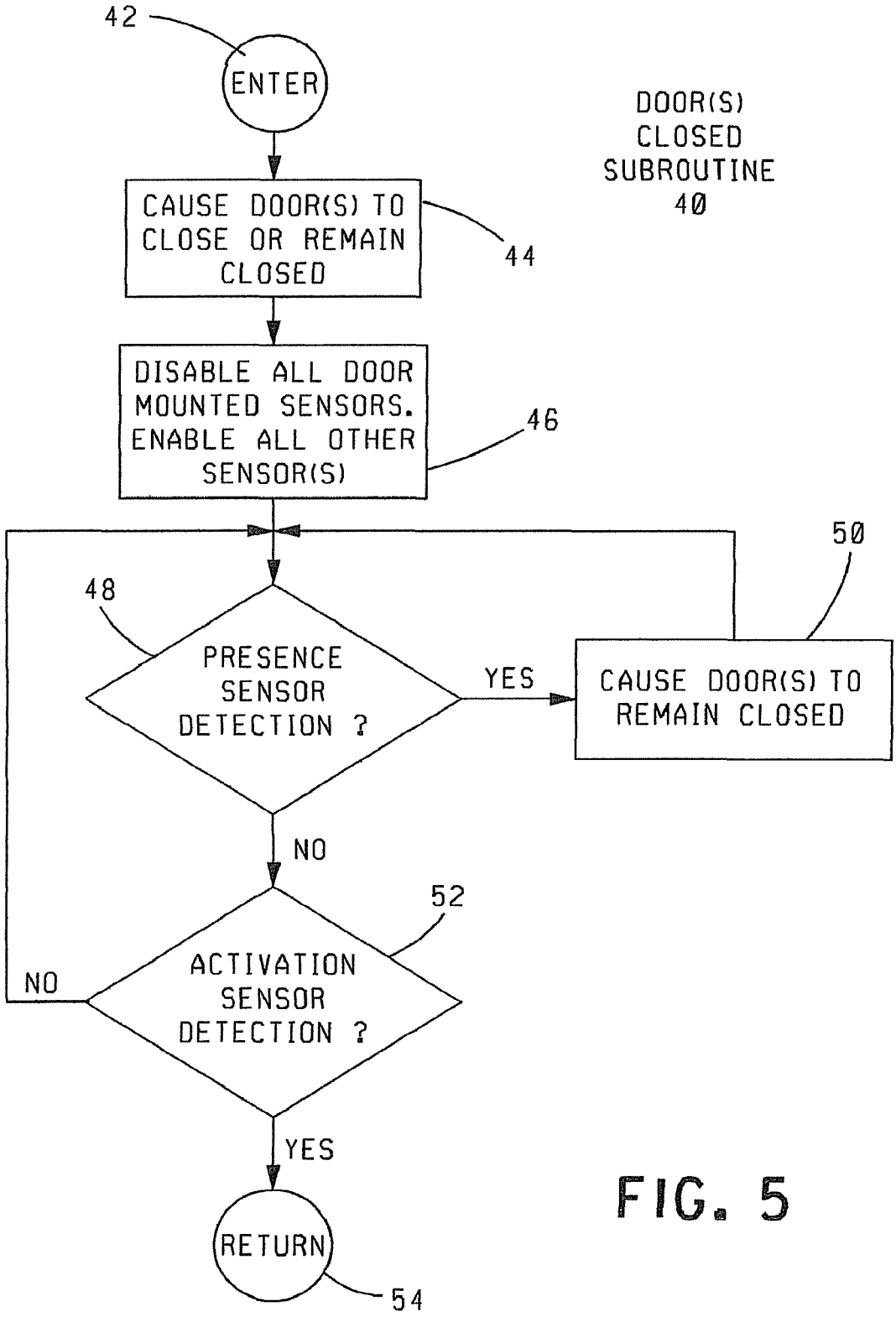
FIG. 5 is a door(s) closed subroutine called by the main control routine of FIG. 4.

With reference to FIG. 5 and with continuing references to all previous figures, the method then advances to step 38 which calls a door(s) closed subroutine 40. Upon entering door(s) closed subroutine 40, the method advances from step 42 to step 44 wherein, under the control of controller 16, motor 18 either closes each door 4 or causes each door 4 to remain closed.

Desirably, any time motor 18 is operative for closing each door 4, controller 16 either disables presence sensor 8 from acquiring images of its field-of-view 22 or controller 16 ceases processing images acquired by presence sensor 8 of its field-of-view 22. Once controller 16 determines from the voltage on the motor winding(s) of motor 18 that door(s) 4 is/are closed, controller 16 can either enable presence sensor 8 to commence acquiring images of its field-of-view or controller 16 can commence processing images acquired by presence sensor 8 of its field-of-view 22. However, this is not to be construed as limiting the invention.

The method then advances to step 46 wherein controller 16 disables each door mounted sensor 10 and 12 and causes all other sensor(s) 6, 8 and 14, if provided, to be enabled.

The method then advances to step 48 wherein controller 16 determines if presence sensor 8 is detecting the presence of an unwanted object in its field-of-view 22. If not, the method advances to step 52. However, if presence sensor 8 detects an unwanted object in its field-of-view 22, the method advances from step 48 to step 50 wherein controller 16 causes motor 18 to maintain each door 4 in its closed position. Thereafter steps 48 and 50 are repeated until controller 16 determines that presence sensor 8 is not detecting the unwanted object in field-of-view 22 whereupon the method advances to step 52.

In order to determine if presence sensor 8 is detecting an unwanted object in its field-of-view 22, controller 16 compares a current image of the field-of-view 22 of presence sensor 8 to the first image of the field-of-view 22 acquired in step 36. Controller 16 interprets no difference between these images as an indication that presence sensor 8 is not detecting the presence of an unwanted object in field-of-view 22. In contrast, controller 16 interprets a difference between these images as an indication that presence sensor 8 is detecting an unwanted object in field-of-view 22.

In step 52, controller 16 determines if activation sensor 6 is detecting motion in field-of-view 20. If not, the method returns to step 48 wherein controller 16 once again determines if presence sensor 8 is detecting the presence of an unwanted object in its field-of-view 22. Desirably, for each iteration of step 48, presence sensor 8 acquires a current image of its field-of-view 22 for the purpose of comparison to the first image acquired in step 36. However, this is not to be construed as limiting the invention.

When operating in accordance with the steps 48 and 50 of the method, controller 16 will cause each door 4 to remain closed if an unwanted object is present in the field-of-view 22 of presence sensor 8, regardless if activation sensor 6 detects motion in its field-of-view 20.

Referring back to step 52, if, in step 52, controller 16 determines that activation sensor 6 has detected motion in its field-of-view 20, the method advances to step 54 for return to step 38 of main control routine 28.

Upon returning to step 38 from door(s) closed subroutine 40, the method advances to step 58 which calls a door(s) opening subroutine 60. Upon entry into door(s) opening subroutine 60, the method advances from step 61 to step 62 wherein controller 16 causes motor 18 to commence opening door(s) 4. The method then advances from step 62 to step 64 wherein controller 16 starts an internal door(s) opening timer.

The method then advances to step 66 wherein controller 16 either disables presence sensor 8 from acquiring images of its field-of-view 22 or controller 16 ceases processing images acquired by presence sensor 8 of its field-of-view 22. In step 66, controller 16 also causes all other sensors 6, 10, 12 and 14, if provided, to be enabled.

The method then advances to step 68 wherein controller 16 determines if any swing side door mounted sensor 10 detects the presence of an object in its corresponding field-of-view 24 or if secondary presence sensor 14, if provided, has been activated. If an object is detected in the field-of-view 24 of any sensor 10 or if secondary presence sensor 14 is activated, the method advances from step 68 to step 70 wherein controller 16 causes the door(s) 4 to stop opening and remain motionless. Thus, an object present in the field-of-view 24 of any sensor 10 or an object activating secondary presence sensor 14, if provided, when the door(s) 4 is/are opening will cause controller 16 to cease opening the door(s) 4 and, thereafter, cause door(s) 4 to remain motionless until the object is no longer present in the field-of-view 24 and secondary presence sensor 14, if provided, is no longer activated.

Assuming in step 68 that no object is detected in field-of-view 24 of any sensor 10 and that secondary presence sensor 14, if provided, has not been activated, the method advances to step 72 wherein controller 16 determines if each door is open. Controller 16 accomplishes this by comparing the voltage on the motor winding(s) of motor 18 in response to driving door(s) 4 to the open position to a predetermined voltage indicative of door(s) 4 in the open position.

If controller 16 determines that the doors(s) is/are open, the method advances to step 74 for return to step 58 in FIG. 4. However, if controller 16 determines that the door(s) 4 is/are not open, the method advances to step 76 wherein controller 16 determines if the door(s) opening timer has timed-out. If so, the method advances to step 74 for return to step 58 in FIG. 4. However, if, in step 76, controller 16 determines that the door(s) opening timer has not timed-out, the method returns to step 68 for another iteration of steps 68, 72, 76 and, as necessary, step 70. Controller 16 continuously repeats the loop comprising steps 68, 72, 76 and, as necessary, step 70, until it determines in step 72 that the door(s) 4 is/are open or determines in step 76 that the door(s) opening timer has timed-out whereupon controller 16 causes the method to advance to step 74 for return to step 58 in FIG. 4.

Figure 7:
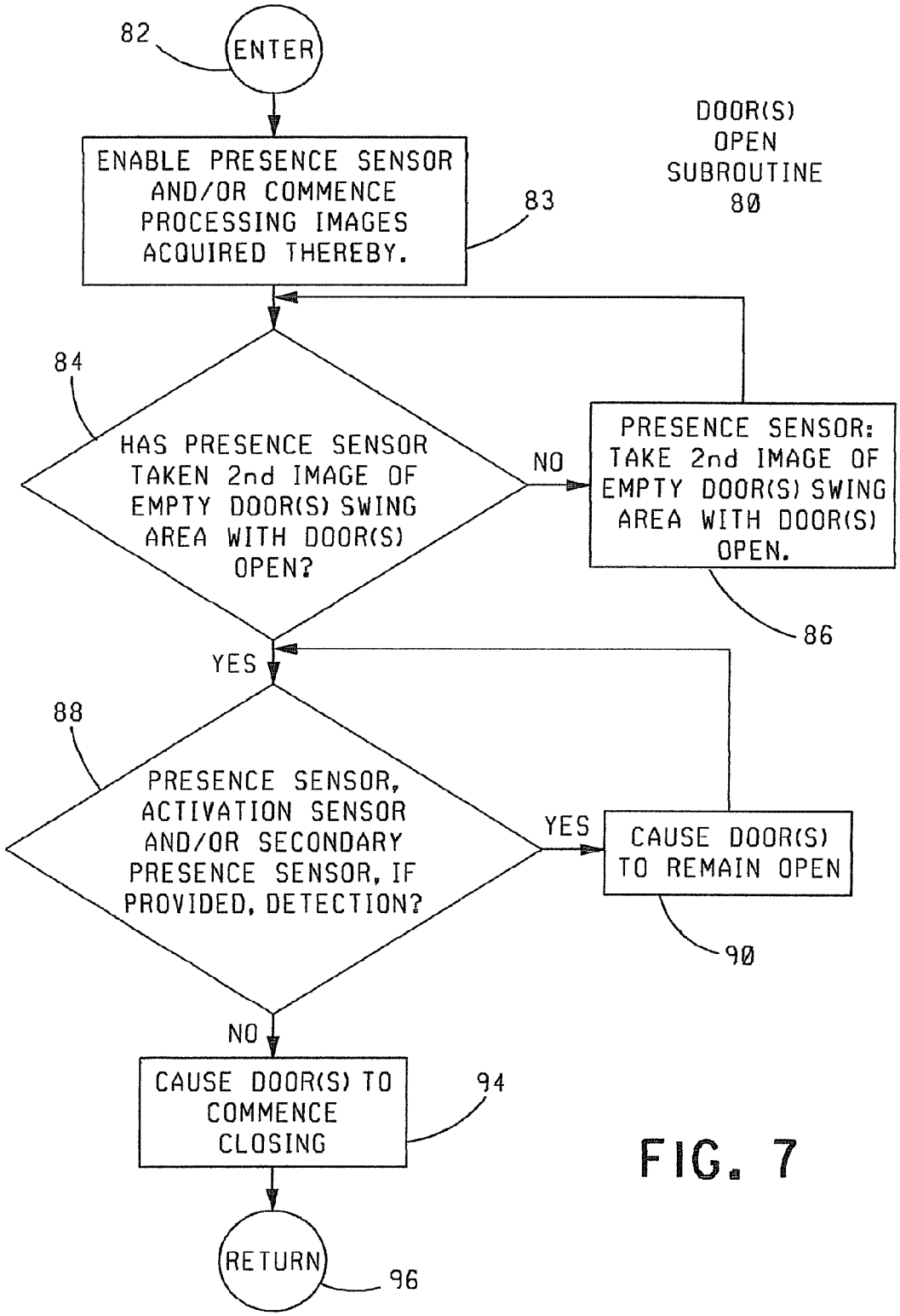
FIG. 7 is a door(s) open subroutine called by the main control routine of FIG. 4.

With reference to FIG. 7 and with continuing reference to all previous figures, upon returning to step 58 from door(s) opening subroutine 60, the method shown in FIG. 4 advances to step 78 which calls a door(s) open subroutine 80 shown in FIG. 7.

Upon entry into door(s) open subroutine 80, the method advances from step 82 to step 83 wherein controller enables presence sensor 8 or commences processing images acquired thereby. Thereafter, the method advances to step 84 wherein controller 16 determines if presence sensor 8 has already acquired a second image of field-of-view 22 with door(s) 4 open. If not, the method advances to step 86 wherein controller 16 causes presence sensor 8 to obtain the second image of field-of-view 22 with door(s) 4 open. Thereafter, the method returns to step 84.

If during any iteration of step 84, controller 16 determines that presence sensor 8 has already acquired a second image of field-of-view 22, the method advances from step 84 to step 88.

In step 88, controller 16 determines if presence sensor 8 is detecting the presence of an undesired object in field-of-view 22; if activation sensor 6 is detecting motion in its field-of-view 20; or if secondary presence sensor 14, if provided, is activated. If so, the method advances to step 90 wherein controller 16 causes the door(s) 4 to remain open. Thereafter, the method returns to step 88.

In order to determine if presence sensor 8 is detecting an unwanted object in its field-of-view 22, controller 16 compares a current image of the field-of-view 22 with door(s) 4 open to the second image of the field-of-view 22 acquired in step 86. Controller 16 interprets no difference between these images as an indication that presence sensor 8 is not detecting the presence of an unwanted object in field-of-view 22. In contrast, controller 16 interprets a difference between these images as an indication that presence sensor 8 is detecting an unwanted object in field-of-view 22.

If during any iteration of step 88, controller 16 determines that presence sensor 8 is not detecting the presence of an undesired object in field-of-view 22; that activation sensor 6 is not detecting motion in field-of-view 20; and that secondary presence sensor 14, if provided, is not activated, the method advances to step 94 wherein controller 16 causes door(s) 4 to commence closing. The method then advances to step 96 for return to step 78 in main control routine 28 shown in FIG. 4.

Figure 8:
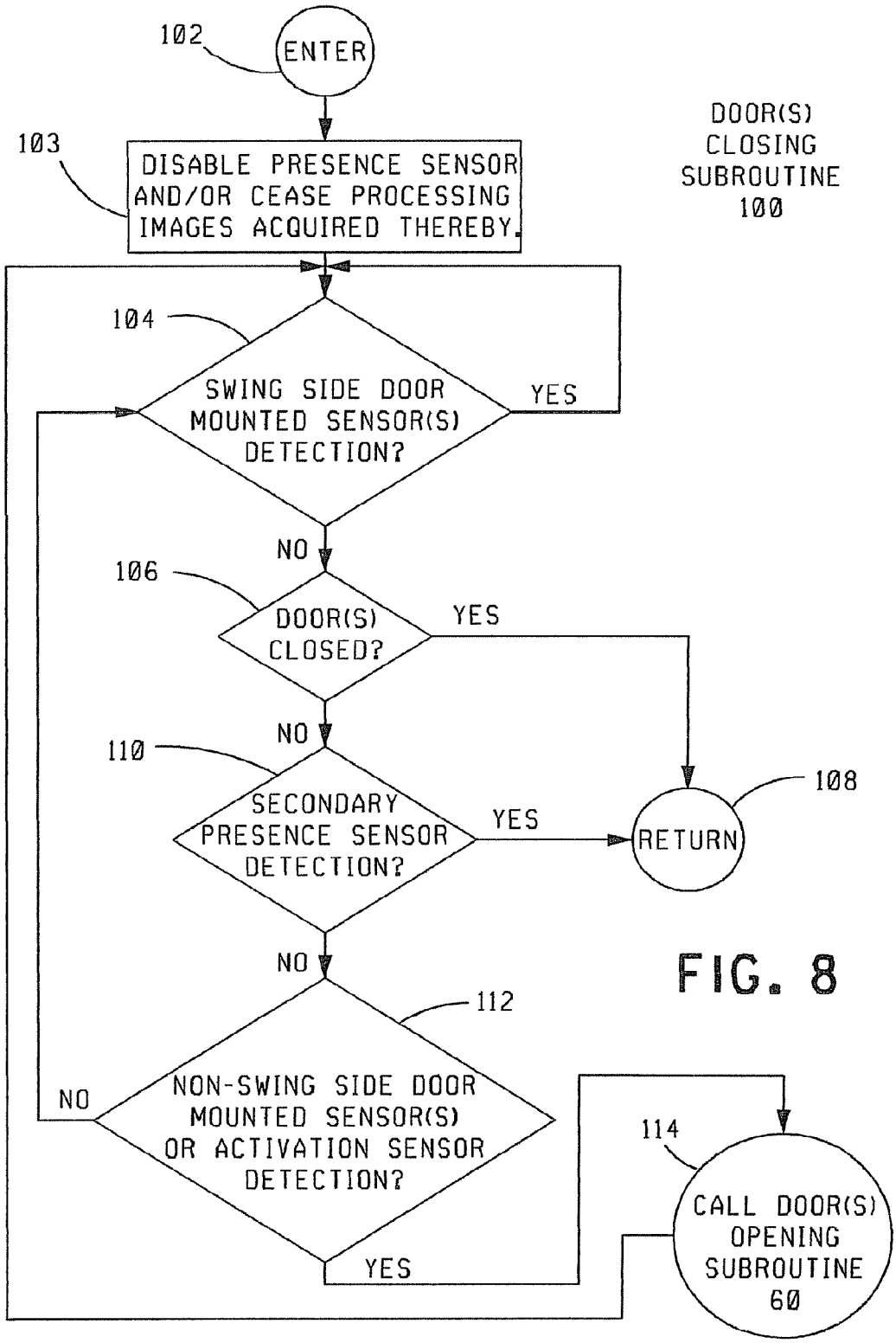
FIG. 8 is a door(s) closing subroutine called by the main control routine of FIG. 4.

With reference to FIG. 8 and with continuing reference to all previous figures, upon return to step 78 in main control routine 28 from the door(s) open subroutine 80 shown in FIG. 7, the method advances to step 98 which calls a door(s) closing subroutine 100 shown in FIG. 8.

Upon entry into door(s) closing subroutine 100, the method advances from step 102 to step 103 wherein controller 16 disables presence sensor 8 or controller 16 ceases processing images acquired thereby. The method then advances to step 104 wherein controller 16 determines if an object is present in the field-of-view 24 of any swing side door mounted sensor 10. If not, the method advances to step 106. Otherwise, the method loops on step 104 until controller 16 determines that the object is no longer present in the field-of-view 24 of any swing side door mounted sensor 10 whereupon the method advances to step 106.

In step 106, controller 16 determines if the door(s) 4 is/are closed. Controller 16 accomplishes this by comparing the voltage on the winding(s) of motor 18 to the predetermined voltage indicative of door(s) 4 being in the closed position.

If controller 16 determines that doors(s) 4 is/are closed, the method advances from step 106 to step 108 for return to step 98 in FIG. 4. However, if door(s) 4 is/are not closed, the method advances from step 106 to step 110 wherein controller 16 determines if secondary presence sensor 14, if provided, has been activated. If so, the method advances from step 110 to step 108 for return to step 98 in the main control routine shown in FIG. 4. However, if secondary presence sensor 14 is not present or if secondary presence sensor 14, if present, is not activated, the method advances from step 110 to step 112.

Figure 6:
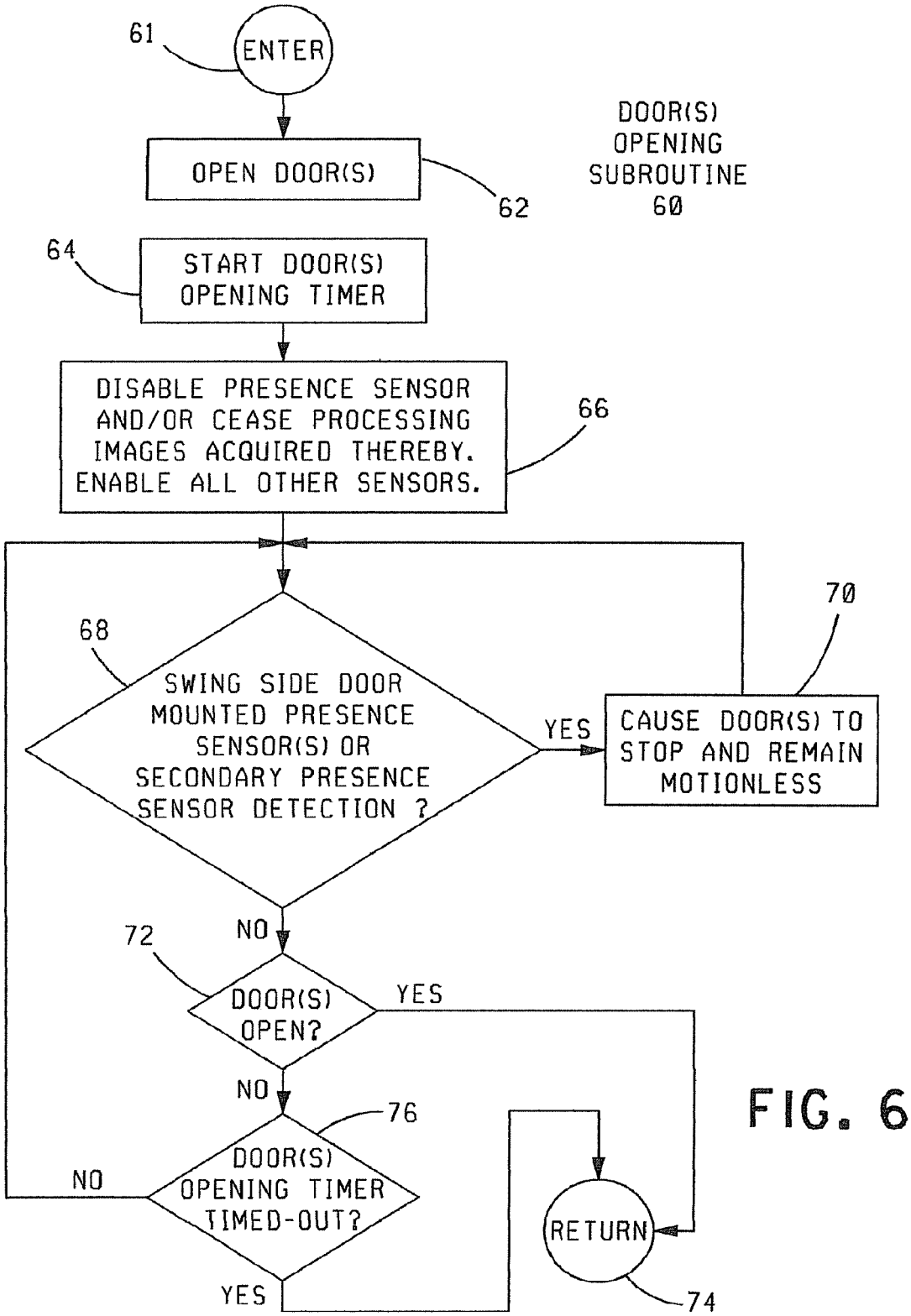
FIG. 6 is a door(s) opening subroutine called by the main control routine of FIG. 4.

In step 112, controller 16 determines if activation sensor 6 has detected motion or if an object has entered the field-of-view 26 of a non-swing side door mounted sensor 12 while the door(s) 4 is/are closing. If so, the method advances from step 112 to step 114 which calls the door(s) opening subroutine 60 shown in FIG. 6. Under the control of door(s) opening subroutine 60, controller 16 causes motor 18 to open door(s) 4. In response to execution of step 74 in door(s) opening subroutine 60, the method returns to step 114 in the door(s) closing subroutine 100 and advances therefrom to step 104 whereafter steps 104-114 are repeated, as necessary, until controller 16 determines in an iteration of step 106 that door (s) 4 is/are closed or determines in an iteration of step 110 that secondary presence sensor 114, if provided, has been activated whereupon the method advances to step 108 for return to step 98 in main control routine 28 in FIG. 4.

Referring back to step 112 in FIG. 8, if controller 16 determines that a non-swing side door mounted sensor 12 has not detected an object entering its field-of-view 26 or that activation sensor 6 has not detected motion in its field-of-view 20, the method advances from step 112 to step 104. Thereafter, steps 104-114 are repeated, as necessary, until controller 16 determines in an iteration of step 106 that door(s) 4 is/are closed or determines in an iteration of step 110 that secondary presence sensor 14, if provided, has been activated whereupon the method advances from step 108 to step 98 of main control routine 28.

Upon returning to step 98 of main control routine 78 from door(s) closing subroutine 100, controller 16 repeats the subroutines called by steps 38, 58, 78 and 98 in main control routine 28. In this manner, controller 16 intelligently controls the opening and closing of door(s) 4 in a manner that is safe and reliable for individuals using said door(s) for passage from field-of-view 20 to field-of-view 22. More specifically, controller 16 operating in accordance the main control routine 28 avoids door(s) 4 from swinging into an object, such as an individual, present in field-of-view 22 when opening or closing.

Desirably, under the controller of controller 16, each sensor 8, 10 and 12 is operated in a manner so as to not interfere with the operation of any other sensor 8, 10 or 12. For example, if each sensor 8, 10 and 12 is an infrared sensor which acquires reflections of infrared light output thereby, said sensor is controlled to output infrared light and to acquire reflections thereof at a time when no other sensor is outputting infrared light or acquiring reflections of infrared light. In this manner, the acquisition by one sensor of reflected infrared light output by another sensor is avoided whereupon the acquired light is not misinterpreted as the presence of an undesired object in a field-of-view. For example, during execution of door(s) opening subroutine 60, controller 16 causes each sensor 10 and 12 to independently acquire one or more reflections of infrared light output thereby in the absence of the other sensor 10, 12 outputting infrared light or acquiring infrared light at the same time. While described in connection with door(s) opening subroutine 60, controller 16 sequentially causing each sensor 8, 10 and 12 to acquire one or more reflections of infrared light output thereby in the absence of any other sensor 8, 10 and 12 outputting infrared light or acquiring reflections of infrared light during the same time period is not to be construed as limiting the invention since this method of controlling the operation of sensors 8, 10 and 12 can be utilized anywhere it is desired to avoid cross-talk or interference between any two or more of sensors 8, 10 and 12.

The present invention has been described with reference to the preferred embodiment. Obvious modifications and alterations will occur to others upon reading and understanding the preceding detailed description. For example, if secondary presence sensor is not present, no decision is based thereon in the foregoing main control routine 28 or any subroutine 40,

60, 80 and 100. It is intended that the invention be construed as including all such modifications and alterations insofar as they come within the scope of the appended claims or the equivalents thereof.

The invention claimed is:

1. A method of controlling a swinging automatic door comprising:

(a) providing means for acquiring images of a first area where the door swings when opening or closing, wherein the means for acquiring images is stationary;

(b) providing means for detecting motion in a second area that fronts a non-swinging side of the door when said door is closed, wherein the means for detecting motion is stationary;

(c) causing the means for acquiring images to acquire a first image and a second image of the first area when the door is closed and open, respectively, and the first area includes no object that would interfere with the opening or closing of the door;

(d) causing the door to transition from closed to open when the means for detecting motion detects motion in the second area and a third image of the first area acquired by the means for acquiring images when the door is closed is the same as the first acquired image;

(e) temporarily ceasing at least one of the following when the door is opening: the acquisition of images from the first area or the processing of images acquired from the first area;

(f) causing the door to transition from open to closed when a fourth image of the first area acquired by the means for acquiring images when the door is open is the same as the second acquired image and the means for detecting motion does not detect motion in the second area; and (g) temporarily ceasing at least one of the following when the door is closing: the acquisition of images from the first area or the processing of images acquired from the first area.

2. The method of claim 1, wherein the means for acquiring images and the means for detecting motion are different.

3. The method of claim 1, further including causing the door to remain closed when the third image of the first area acquired by the means for acquiring images is different than the first acquired image.

4. The method of claim 1, further including causing the door to remain open when the fourth image of the first area acquired by the means for acquiring images is different than the second acquired image.

5. The method of claim 1, further including repeating steps (d)-(g).

6. The method of claim 1, further including:

providing means for detecting the presence of an object adjacent a swing side of the door, wherein the means for detecting the presence of the object is coupled to the door and moves with the opening and closing of the door; and when the door is opening, causing the door to cease opening and remain motionless when the means for detecting the presence of the object detects an object adjacent the swing side of the door.

7. The method of claim 6, wherein:

the means for detecting the presence of the object acquires images of a third area adjacent the swing side of the door; and the door is caused to cease opening and remain motionless when a difference is detected between two or more images acquired of the third area by the means for detecting the presence of the undesired object when the door is opening.

8. The method of claim 1, further including:

providing means for detecting the presence of an object adjacent the non-swinging side of the door, wherein the means for detecting the presence of the object is coupled to the door and moves with the opening and closing of the door; and when the door is closing, causing the door to transition from closing to open when the means for detecting the presence of the object detects an object adjacent the non-swinging side of the door.

9. The method of claim 8, wherein:

the means for detecting the presence of the object acquires images of a fourth area adjacent the non-swinging side of the door; and the door is caused to transition from closing to open when a difference is detected between two or more images acquired of the fourth area by the means for detecting the presence of the object when the door is closing.

* * * * *